United States Patent [19]

Toda

[11] Patent Number: 4,783,912

[45] Date of Patent: Nov. 15, 1988

[54] RESIN SKI BOOT

[75] Inventor: Koji Toda, Hamamatsu, Japan

[73] Assignee: Yamaha Corporation, Japan

[21] Appl. No.: 76,273

[22] Filed: Jul. 22, 1987

[30] Foreign Application Priority Data

Jul. 29, 1986 [JP] Japan ..... 61-117112[U]

[51] Int. Cl.[4] ..... A43B 5/04

[52] U.S. Cl. ..... 36/120; 36/119; 36/121

[58] Field of Search ..... 36/117–121, 36/87, 50

[56] References Cited

U.S. PATENT DOCUMENTS

| | | | |
|---|---|---|---|
| 4,160,332 | 7/1979 | Salomon | 36/119 |
| 4,222,184 | 9/1980 | Kastinger | 36/121 |
| 4,382,342 | 5/1983 | Spademan | 36/119 |
| 4,539,763 | 9/1985 | Walkhoff | 36/120 |
| 4,644,671 | 2/1987 | Walkhoff | 36/119 |
| 4,711,042 | 12/1987 | Morell et al. | 36/117 X |

FOREIGN PATENT DOCUMENTS

| | | | |
|---|---|---|---|
| 2907163 | 8/1980 | Fed. Rep. of Germany | 36/120 |
| 3524792 | 1/1986 | Fed. Rep. of Germany | 36/119 |

*Primary Examiner*—James Kee Chi

*Attorney, Agent, or Firm*—Lerner, David, Littenberg, Krumholz & Mentlik

[57] ABSTRACT

In construction of a ski boot having a rearcuff turnably mounted to a shell via pivots and an instep pad for pressing an wearer's foot being pulled by a tensioner on the rearcuff via a wire, the wire extends in engagement with a seat located upwards and rearwards of the pivot, thereby concurrently sufficing two major functional demands for a ski boot.

4 Claims, 2 Drawing Sheets

RESIN SKI BOOT

BACKGROUND OF THE PRESENT INVENTION

The present invention relates to an improved resin ski boot, and more particularly relates to improvement in a resin ski boot having a rigid resin shell adapted for accommodating an inner boot which is in direct contact with wearer's foot and leg.

Such a conventional resin ski boot in general has the following basic construction. A rigid shell for accommodating an inner boot includes a lower section covering a wearer's instep and an upper section covering the front half of a wearer's leg. A pair of pivots are formed on opposite sides of the lower section near the lower and rear corner thereof and a rearcuff, which is adapted for covering the rear half of the wearer's leg, is turnably mounted near its lower and fore corner to the pivots on the lower section of the shell. Thus, the rearcuff is turnable forwards and rearwards about the pivots. The shell and the rearcuff are secured together by a locker mechanism extending between the two components. A pad is arranged within the shell at a position facing the wearer's instep and a tensioner is arranged on the rear face of the rearcuff. The pad and the tensioner are connected to each other by a wire and this wire engages with a seat formed on the lower section of the shell near the above-described pivot.

Resin ski boots of such a basic construction are disclosed in Japanese Patent Openings Nos. Sho.52-118360, Sho.59-137001 and Sho.60-225502.

A resin ski boot is in general required to satisfy the following functional demands.

First, the rearcuff is often released during walking. Possible slack on wire in this state would cause unstable condition of the wearer's foot in the ski boot and hamper smooth walking. In order to prevent this trouble, the wire should be maintained tight even when the rearcuff is released during walking.

Second, when the wearer's leg is inclined forwards during skiing, the heel tends to lift from the bottom of the shell. In order to correct this, the wire should be arranged to firmly hold the wearer's foot under this condition.

In the above-described Japanese Patent Opening No. Sho.52-118360, the seat for the wire is located downwards and rearwards of the pivot for the rearcuff. Due to such a location of the seat for the wire, slack appears on the wire when the rearcuff is released. That is, the ski boot of this prior art does not satisfy the first functional demand. In the construction of the ski boot of Japanese Patent Opening No. Sho.59-13001, the location of the seat for the wire overlaps that of the pivot for the rearcuff and, due to such a positioning the wire is not fastened when the wearer's leg is inclined forwards. Thus, the ski boot of this prior art does not satisfy the second functional demand. The seat for the wire of the ski boot of Japanese Patent Opening No. Sho.60-225502 is located right above the pivot for the rearcuff and, as such, slack appears on the wire when the wearer's leg is inclined forwards. The ski boot of this prior art does not again satisfy the second functional demand.

As is clear from the foregoing, none of the ski boots of the prior art concurrently satisfy the above-described first and second functional demands.

SUMMARY OF THE INVENTION

It is the object of the present invention to provide a ski boot which concurrently satisfies the above-described two functional demands for a ski boot.

In accordance with the basic concept of the present invention, a seat for a wire is located upwards and rearwards of a pivot for a rearcuff on a resin ski boot.

DESCRIPTION OF THE PREFERRED EMBODIMENTS

Figure 1:
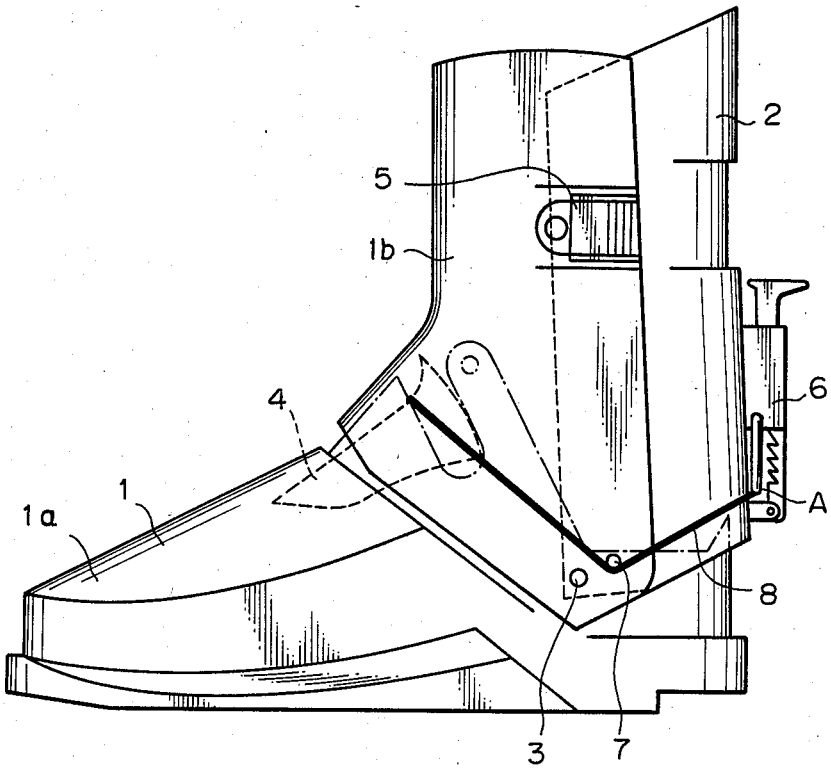
FIG. 1 is a simplified side view of one embodiment of the ski boot in accordance with the present invention.

One embodiment of the ski boot in accordance with the present invention is shown in FIG. 1, in which parts unrelated to the present invention are either simplified or omitted for better understanding. The ski boot has a rigid resin shell 1 which, as in the prior art, includes a lower section 1*a* for covering the wearer's foot and an upper section 1*b* for covering the forward half of the wearer's leg. A pair of opposite pivots 3 are formed on the outer face of the shell 1 near its lower rear corner and a rearcuff 2 for covering the rear half of the wearer's leg is turnably mounted to the pivot 3 on the shell 1. The rearcuff 2 and the upper section 1*b* of the shell 1 can be secured to each other by a known locker mechanism extending between the two components. Only a buckle 5 of the locker mechanism is shown in the drawing.

A pad 4 is arranged in the shell 1 in an arrangement in which, when the wearer's foot is inserted, it faces the instep of the wearer's foot. A tensioner 6 is arranged on the rear face of the rearcuff 2. The pad 4 is connected to the tensioner 6 by a wire 8 which engages with a seat 7 formed on the outer face of the lower section 1*a* of the shell 1 near its rear end.

In accordance with the present invention, the seat 7 for the wire 8 is located upwards and rearwards of the pivot 3 for the rearcuff 2. More specifically, when a graph is assumed to include an abscissa drawn in parallel to the bottom of the ski boot and an ordinate intersecting the abscissa at the pivot 3 for the rearcuff 2, the seat 7 for the wire 8 should be located in a zone between the positive abscissa and the positive ordinate of the graph.

Figure 2:
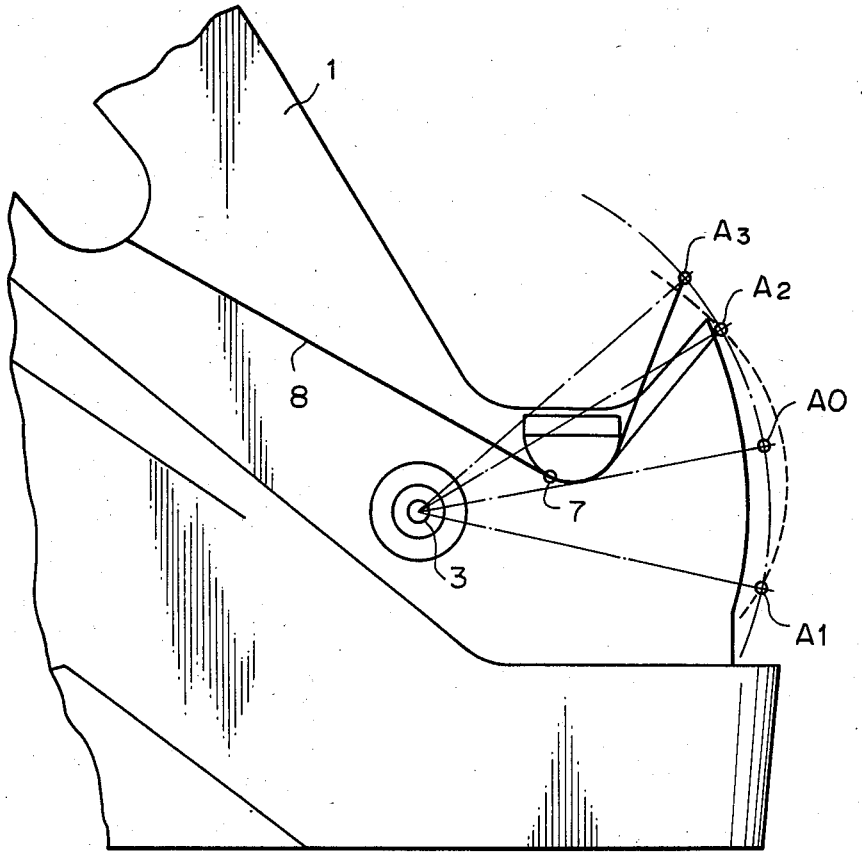
FIG. 2 is diagram for showing the operational mechanism of the ski boot in accordance with the present invention.

Next, the operation mechanism of the ski boot in accordance with the present invention will be explained in detail in reference to FIG. 2 which shows the condition of the junction A of the wire 8 with the tensioner 6 as the rearcuff 2 turns about the pivot on the shell 1. Since the junction A is located on the rear face of the rearcuff 2 which turns about the pivot 3, the junction A along a chain line arc having its center on the pivot 3. In practice, however, since the wire 8 engages with the seat 7 off the position of the pivot 3, the junction A has a tendency to move along a dot line arc having its center on the seat 7. The rearcuff 2 is released at a location A1, and closed at a location A2 to be secured to the upper section 16 of the shell 1. At a location A3, the wearer's leg is inclined forwards during skiing.

It will be found from the illustration that the junction A actually moves along the chain line arc although it has a tendency to move along the dot line. So, tension appears on the wire 8 when the chain line arc falls outside the dot line arc. Whereas slack appears on the wire 8 when the chain line arc falls inside the dot line arc. In the ambits above the location A2 and below the location A1, the chain line arc falls outside the dot line arc so that tension should appear on the wire 8. In the ambit between the locations A1 and A2, the chain line arc falls inside the dot line arc so that slack should appear on the wire 8. The maximum slack on the wire appears at a location AO. It will be well understood from the foregoing that the difference between the chain line and dot line courses produces slack or tension on the wire 8.

In accordance with the present invention, no slack appears on the wire 8 when the rearcuff 2 is released in order to stably hold the wearer's foot. When the wearer's leg is inclined forwards, the wire 8 is fastened to firmly hold the heel of the wearer's leg against tendency of moving away from the bottom of the boot.

I claim:

1. An improved resin ski boot comprising a rigid shell adapted for accommodating an inner boot in contact with the foot and leg of a wearer, said rigid shell including a lower section for covering said wearer's foot and an upper section for covering the front portion of said wearer's leg, cuff means for covering the rear portion of said wearer's leg, said cuff means including an upper end and a lower end;

pivot means for pivotably mounting said lower end of said cuff means to said lower section of said rigid shell whereby said cuff means can be pivoted between a closed position proximate to said upper section of said rigid shell for enclosing said wearer's leg and an open position, said pivot means being located in a predetermined position defining a horizontal plane parallel to said lower section of said rigid shell and a vertical plane perpendicular to said horizontal plane at said pivot means;

wire means for connecting said lower section of said rigid shell to said cuff means; and seat means contacting an intermediate location on said wire means for applying tension to said wire means, said seat means being located above said horizontal plane and rearward of said vertical plane with respect to said pivot means.

2. The ski boot apparatus according to claim 1 further including tensioning means mounted on the outer surface of said cuff means.

3. The ski boot apparatus according to claim 2 further including pad means mounted within said lower section of said rigid shell at a location adapted to face the instep of said wearer's foot.

4. The ski boot apparatus of claim 3 further including fastening means for fastening said cuff means to said upper section of said rigid shell when said cuff means is in said closed position.

* * * * *